United States Patent [19]

Mori et al.

[11] Patent Number: 4,612,427

[45] Date of Patent: Sep. 16, 1986

[54] SWITCH

[75] Inventors: Teijiro Mori, Nishinomiya; Hiroyuki Okado, Owariasahi; Shizutaka Nishizako, Tajimi; Shigeharu Otsuka, Gifu; Shigeru Masuda, Ichinomiya, all of Japan

[73] Assignee: Mitsubishi Denki Kabushiki Kaisha, Tokyo, Japan

[21] Appl. No.: 629,536

[22] PCT Filed: Nov. 4, 1983

[86] PCT No.: PCT/JP83/00396

§ 371 Date: Jul. 2, 1984

§ 102(e) Date: Jul. 2, 1984

[87] PCT Pub. No.: WO84/02032

PCT Pub. Date: May 24, 1984

[30] Foreign Application Priority Data

| | | | |
|---|---|---|---|
| Nov. 10, 1982 | [JP] | Japan | 57-197059 |
| Dec. 3, 1982 | [JP] | Japan | 57-183202 |
| Dec. 24, 1982 | [JP] | Japan | 57-229544 |

[51] Int. Cl.[4] ..... H01H 33/20

[52] U.S. Cl. ..... 200/144 R; 200/147 R

[58] Field of Search ..... 200/144 R, 147 R

[56] References Cited

U.S. PATENT DOCUMENTS

| | | | |
|---|---|---|---|
| 3,997,746 | 12/1976 | Harper et al. | 200/144 R |
| 4,086,460 | 4/1978 | Gillette | 200/144 R |
| 4,477,704 | 10/1984 | Mori et al. | 200/144 R |

FOREIGN PATENT DOCUMENTS

| | | |
|---|---|---|
| 5828936 | 8/1981 | Japan . |
| 56-135647 | 10/1981 | Japan . |

*Primary Examiner*—Robert S. Macon

*Attorney, Agent, or Firm*—Robert E. Burns; Emmanuel J. Lobato; Bruce L. Adams

[57] ABSTRACT

This invention aims at the reduction of stationary contact element wear and at realizing a significant improvement in the interrupting capability by providing a stationary contact having a hollow cut-out portion formed therein in the vicinity of the portion at which said contact element is joined, and an arc runner electrically connected to said stationary contact at an edge of said hollow cut-out portion closest to said contact element, the arc runner being extended above said hollow cut-out portion.

16 Claims, 12 Drawing Figures

FIG. 4(b)
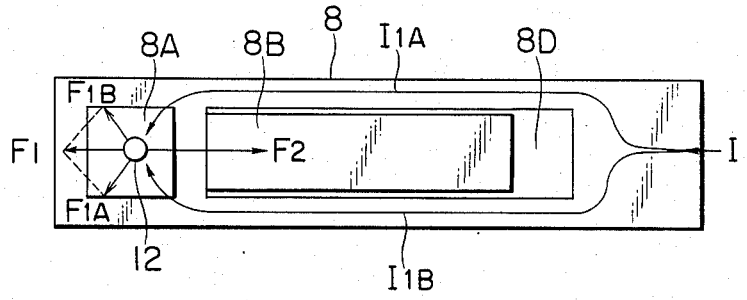
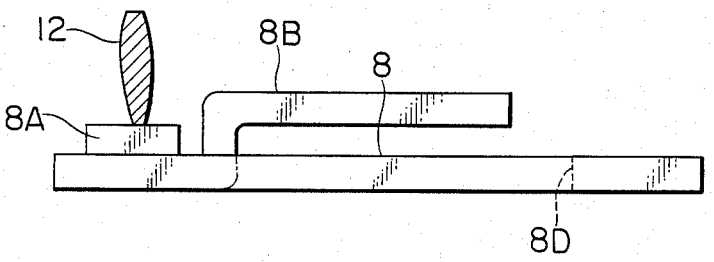
FIG. 4(a)

SWITCH

TECHNICAL FIELD

This invention relates to switches for allowing an electric current to flow or to be interrupted, and more particularly to arc extinguishing mechanisms for such switches.

TECHNICAL BACKGROUND

Switches to which the present invention is applicable include electromagnetic contactors and wiring interrupters.

First, one example of a conventional electromagnetic contactor will be described with reference to FIG. 1. In FIG. 1, (1) is a mount bed molded from a plastic material, (2) is a stationary iron core of silicon steel laminations disposed on the mount bed, (3) is a movable core disposed in a facing-relationship with the stationary core (2) and made of silicon steel laminations, (4) is an operating coil for providing a driving force which attracts the movable core (3) to the stationary core (2) against a trip spring (not shown), and (5) is a cross bar made of a plastic material and having a rectangular window, the bottom end of which has attached thereto the movable core (3). (6) is a movable contact inserted within the rectangular window of the cross bar (5) and held under pressure by a compression spring (7), (6A) is a movable contact (6) element disposed on the movable contact, (8) is a stationary contact facingly disposed with respect to the movable contact (6) for conducting a current, (8A) is a stationary contact element disposed on the stationary contact (8), and (8C) is a terminal portion for the stationary contact (8). (9) is a terminal screw for connecting the electromagnetic contactor main body to an external circuit, (10) is a base for mounting the stationary contact (8), and (11) is a cover for covering the upper portion of the electromagnetic contactor. The manner of mounting of the stationary contact (8) and the stationary contact element (8A) is shown in the enlarged views of FIGS. 2(*a*) and 2(*b*).

Since the conventional electromagnetic contactor has the above-described structure, when the operating coil (4) is de-energized, the unillustrated trip spring causes the movable core (3) to separate from the stationary core (2) and the cross bar (5) occupies the position shown in FIG. 1, whereby the movable contact element (6A) and the stationary contact element (8A) are separated to generate an electric arc (12), the arc (12) being extinguished at the zero current point to interrupt the electric current.

In the conventional electromagnetic contactor, as shown in FIG. 3, the arc (12) is subjected to a driving force $F_2$ due to a magnetic field formed by a current I flowing through the movable contact (6) and a driving force $F_1$ due to a magnetic field formed by a current I flowing through the stationary contact (8). Since the driving forces $F_1$ and $F_2$ are substantially equal in intensity and opposite in direction, the arc (12) stays on the movable contact element (6A) and the stationary contact element (8A). Thus, since the arc (12) is not driven, the legs of the arc do not move outside of the contact elements thereby resulting in large disadvantage that the wear of the contact elements occurs.

DISCLOSURE OF THE INVENTION

With the above points in view, the present invention has as its object to reduce the contact element wear and to improve the interrupting capability by modifying the arrangement of the stationary contact itself.

One object of the present invention is to reduce the contact element wear and significantly improve the interrupting capability by providing a hollow cut-out portion in the stationary contact in the vicinity of the stationary contact element, and providing an electrically integral arc runner on the stationary contact at an edge of the hollow cut-out close to the contact element, the arc runner extending above the hollow portions.

Another object of the present invention is to reduce the contact element wear and improve the interrupting capability by providing a hollow cut-out portion formed in the stationary contact between its one end and the position on which the stationary contact element is mounted, and an arc runner one end of which is electrically connected to the stationary contact at a position between the stationary contact element and the hollow cut-out portion, the arc runner extending into an arc extinguishing space at an angle relative to the opposing faces of the stationary contact and the movable contact.

Still another object of the present invention is to achieve the reduction of the contact element wear and further improve in the interrupting capacity by providing a hollow cut-out portion formed in the stationary contact in the vicinity of the stationary contact element, and an electrically integral, inverted L-shaped arc runner on the stationary contact and disposed at an edge of the hollow cut-out portion closest to the contact element, a horizontally extending portion of the arc runner extending above the hollow cut-out portion, and by providing a channel below the hollow cut-out portion, the channel communicating to the exterior.

BRIEF DESCRIPTION OF THE DRAWINGS

FIGS. 4 and 5 are views illustrating the operation of the stationary contact of an embodiment of the present invention;

BEST MODE FOR WORKING THE INVENTION

Figure 1:
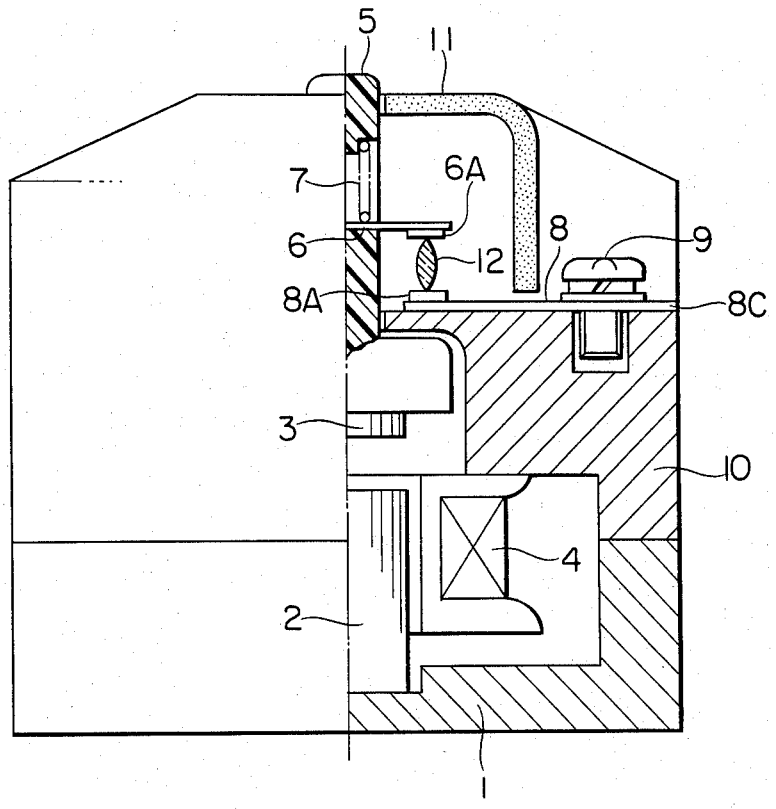
FIG. 1 PRIOR ART
FIG. 1 is a partial sectional view of a conventional electromagnetic contactor.
Figure 2B:
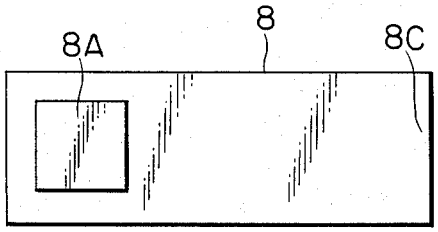
FIG. 2(b) PRIOR ART
FIGS. 2(*a*) and 2(*b*) are enlarged views showing the stationary contact shown in FIG. 1.
Figure 2A:
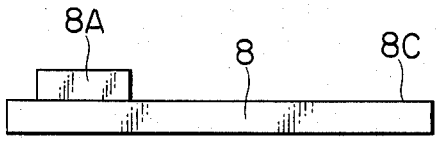
FIG. 2(a) PRIOR ART
Figure 3:
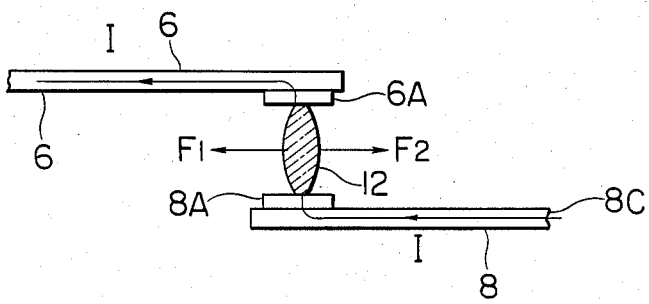
FIG. 3 PRIOR ART
FIG. 3 is an explanatory view illustrating the behavior of the arc on the stationary contact of a conventional electromagnetic contactor.

The present invention will now be described in conjunction with embodiments shown in FIGS. 4, 5 and 6. Since the electromagnetic contactor of this embodiment has the same structure as the aforedescribed prior art electromagnetic contactor except for the configuration of the stationary contact (8), only the configuration of the stationary contact (8) is shown in FIG. 4. As seen from the figures, the stationary contact (8) is provided with a hollow cut-out portion (8D) in the vicinity of the position on which the contact element (8A) is mounted, and the hollow cut-out portion (8D) and the contact element (8A) both lie on the lengthwise or longitudinal axis of the stationary contact (8). An inverted L-shaped arc runner (8B) is formed to rise from an edge of the hollow portion (8D) close to the contact element or on the left end as seen in FIG. 4. Therefore, an electric current I flowing through the stationary contact (8) is divided into currents $I_{1A}$ and $I_{1B}$ on both sides of the hollow portion (8D) and the currents flow into an electric arc (12). Forces that act on the arc due to the above currents are illustrated by arrows in FIG. 4(*b*). In this figure, the forces due to currents $I_{1A}$ and $I_{1B}$ are shown as $F_{1A}$ and $F_{1B}$, and the resultant force of $F_{1A}$ and $F_{1B}$ is shown as $F_1$. On the other hand, a force due to the current flowing through a movable contact (6) is shown by $F_2$. Since $F_2 \approx 2F_{1A} \approx 2F_{1B}$, $F_2$ is greater than $F_1$. Therefore, the arc (12) is driven toward the arc runner (8B) of the stationary contact, so that the leg of the arc (12) on the stationary contact element (8A) is transferred onto the arc runner (8B) as shown by the arc (12A) shown in FIG. 5. The arc (12), once transferred to the arc runner (8B), is further driven by an electric current flowing through the arc runner (8B) to rapidly travel on the arc runner (8B) as shown by the arc (12B), whereby the arc (12) is further elongated and extinguished. Thus, with the above described electromagnetic contactor, the current zero point occurs while the arc (12) is rapidly traveling along the arc runner (8B) while being elongated, so that the charged particles of the arc (12) are quickly scattered and the leg portion of the arc (12) is efficiently cooled, thereby providing a superior interrupting capability. Also, since the leg of the arc (12) transfers from the stationary contact (8A) onto the arc runner (8B), the wear of the stationary contact (8A) is significantly reduced. As to the configuration of the stationary contact (8), an advantageous effect similar to that shown in FIG. 4 is obtained even with the terminal configuration having a U-shaped end portion (8C) shown in FIG. 6.

Further, since the arc runner (8B) is positioned in the vicinity of the stationary contact (8), the arc (12A) moving along the arc runner (8B) is subject to a reaction force due to an electric current flowing through the stationary contact (8), whereby the arc travel speed is reduced. For this reason, it has been found that it is necessary to reduce the reaction force acting against the arc driving force due to a magnetic field formed by an electric current flowing through the stationary contact (8) to further improve the interrupting capability.

Figure 7:
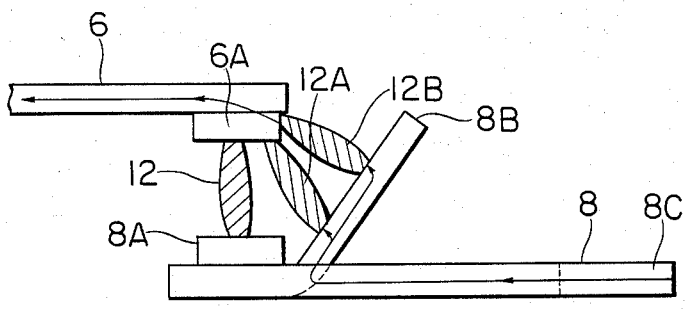
FIG. 7 is an explanatory view illustrating the arc extinguishing mechanism of still another embodiment of the present invention.

FIG. 7 is a view illustrating an arc extinguishing mechanism for the arc (12) according to another embodiment for dissolving the above mentioned problem. In the figure, the arc runner (8B) is sloped with respect to the opposing faces of the stationary contact (8) and the movable contact (6) and extends, in this embodiment, in a straight line into the arc extinguishing space. The term "arc extinguishing space" refers to a space defined between a plane including the stationary contact (8) and a plane including the movable contact (6) and in which the arc (12) is allowed to exist.

Figure 5:
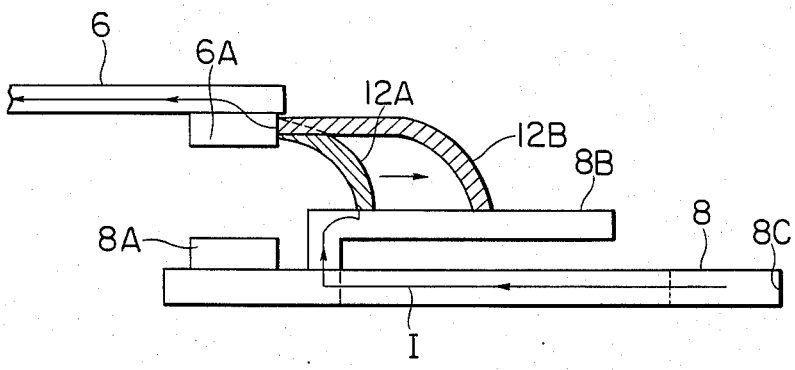
Figure 6:
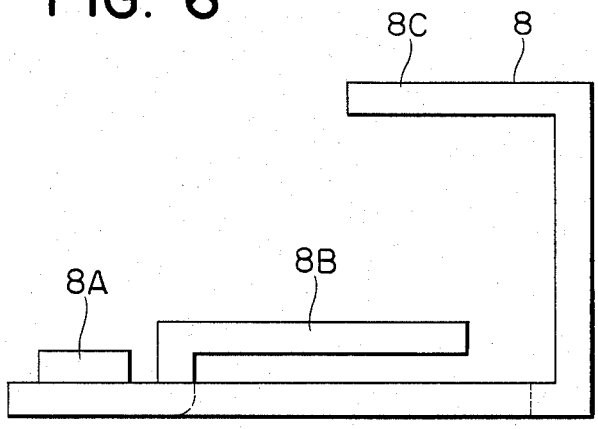
FIG. 6 is a side view showing another embodiment of the present invention.

The arc (12) generated between the stationary contact element (8A) and the movable contact element (6A) is driven toward the arc runner (8B) for the same reason as in the case of the embodiment shown in FIGS. 4 to 6, and the leg of the arc (12) is transferred onto the arc runner (8B) as shown by the arc (12A) and travels along the arc runner (8B). The current zero point arrives while the arc (12B) is travelling along the arc runner (8B) and the current is interrupted. Since the arc runner (8B) of this embodiment is sloped relative to the opposing faces of the stationary contact (8) and the movable contact (6) and, in this embodiment, extends in a straight line into the arc extinguishing space, the arc runner (8B) extends from the stationary contact (8) in the direction of the arc movement. Therefore, the effect of a reaction force aginst the arc driving force due to the magnetic field formed by the current flowing through the stationary contact (8) is decreased as the arc moves, so that the travel speed of the arc (12A) increases as a function of time. Thus, since the current zero point arrives while the arc (12A) is rapidly moving, the charged particles of the arc (12A) are more quickly scattered and the leg portion of the arc (12A) is more efficiently cooled, thereby significantly improving the interrupting capability.

Figure 8:
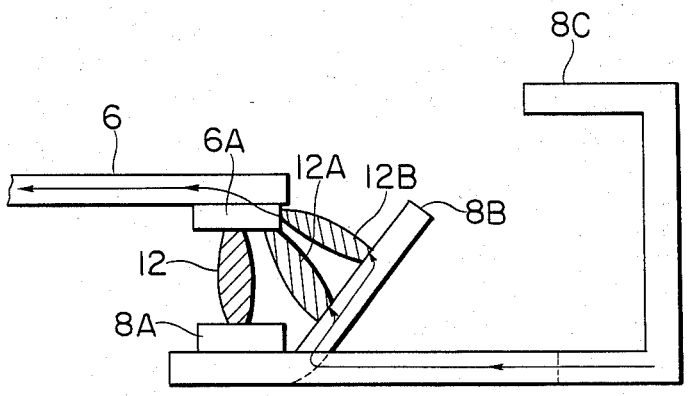
FIGS. 8 and 9 are explanatory views illustrating still another embodiment of the present invention.

Further, since the leg of the arc (12) transfers from the stationary contact element (8A) to the arc runner (8B), the wear of the stationary contact element (8A) is lessened. The stationary contact (8) may have an end portion of a U-shaped cross-section as shown in (FIG. 8).

Figure 9:
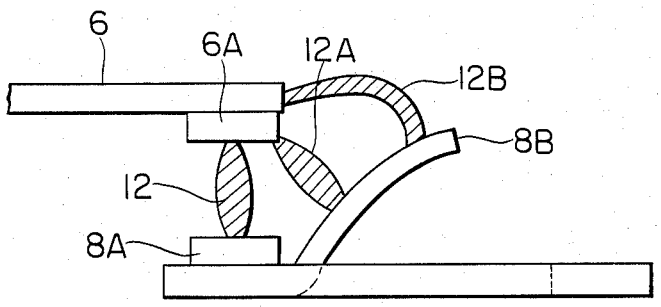

Also, although the straight arc runner (8B) is illustrated in the embodiment described above, any shape may be employed as long as the distance of the arc runner (8B) from the stationary contact (8) increases as the arc runner extends from the portion of the arc runner (8B) joined to the stationary contact (8). One example in which the arc runner (8) has an arc shape is shown in FIG. 9. In the embodiment of FIG. 9, as the leg of the arc (12) moves away from the joined portion between the arc runner (8B) and the stationary contact (8), the distance from the stationary contact (8) increases and the arc is elongated correspondingly, so that a still more superior interrupting capability is obtained.

Figure 10:
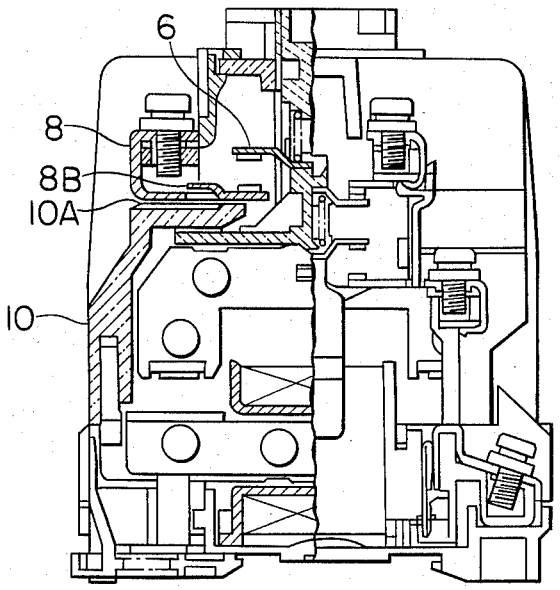
FIG. 10 is a side view illustrating still another embodiment of the present invention.

Further, the stationary contact (8) is mounted on a base (10) as shown in FIG. 10, and the base (10) may be provided with a groove or channel (10A) extending from below the hollow cut-out portion (8D) of the stationary contact (8) to the exterior. Then, an arced gas within the arc extinguishing region is exhausted through the hollow portion (8D) of the stationary contact (8) and through the channel (10A) to the exterior. Therefore, the gas ionized after the generation of the arc is quickly exhausted from the hollow cut-out portion (8D) through the channel (10A) in the base (10) to the exterior, whereby the arc on the stationary contact element (8A) rapidly transfers to the arc runner (8B).

Thus, according to the electromagnetic contactor shown in FIG. 10, since the arced gas is quickly exhausted, the arc rapidly moves along the arc runner (8B) while it is being elongated, and then the current zero point arrives, the charged particles of the arc are quickly scattered, the leg portion of the arc is efficiently cooled, and a superior interrupting capability is provided. Also, since the leg of the arc quickly transfers from the stationary contact element (8A) to the arc runner (8B) to shorten the time during which the arc remains on the stationary contact element (8A) as well as decrease the arcing time, the wear of the stationary contact element (8A) can be significantly reduced. The channel (10A) may be formed by holes or grooves of various shapes.

Further, although the description has been made in terms of the embodiments of the present invention applied to switches in which the contacts are operated by a magnet i.e., electromagnetic contactors, the present invention may equally be applicable to other switches such as wiring.

We claim:

1. A switch comprising: a housing; a stationary contact mounted in the housing; a stationary contact element joined to the stationary contact; a movable contact movably mounted in the housing for movement toward and away from the stationary contact; a movable contact element joined to the movable contact for movement therewith and being disposed in opposed facing relation to the stationary contact element; the stationary contact having a hollow cut-out portion spaced from but in the vicinity where the stationary contact element is joined thereto; and an arc runner electrically connected to the stationary contact at a location between the stationary contact element and stationary contact cut-out portion, the arc runner extending outwardly from the stationary contact and extending over at least part of the stationary contact cut-out portion, and the arc runner having a configuration effective to ensure that the distance between the arc runner and movable contact element does not increase during at least the initial course of movement of the movable contact element away from the stationary contact element.

2. A switch according to claim 1; wherein the stationary contact has a lengthwise axis, and the stationary contact element and stationary contact cut-out portion both lie on the lengthwise axis.

3. A switch according to claim 1; wherein the stationary contact has only one stationary contact element joined thereto.

4. A switch according to claim 3; wherein the stationary contact cut-out portion establishes in the stationary contact two current paths, one on each side of the cut-out portion, for current flowing along the length of the stationary contact to the stationary contact element, the two current paths coverging at the stationary contact element.

5. A switch according to claim 1; wherein the stationary contact comprises an elongate plate-like member, and the arc runner comprises an upwardly bent portion of the plate-like member.

6. A switch according to claim 1; wherein the stationary contact and the arc runner comprise a one-piece integral structure.

7. A switch according to claim 1; wherein the arc runner has a proximate end connected to the stationary contact and a freely extending distal end.

8. A switch according to claim 1; wherein the arc runner has a convex configuration as viewed from the movable contact element.

9. A switch as claimed in claim 1, characterized in that said arc runner has an L-shaped cross-section, said arc runner comprising a vertical leg portion positioned in the vicinity of sides of said stationary contact element and a horizontal leg portion connected to said vertical leg portion and extending above said hollow cut-out portion of the stationary contact.

10. A switch as claimed in claim 9, characterized in that said vertical leg portion of the arc runner extends to a position closer to the movable contact element than the joined face between the stationary contact element and the movable contact element.

11. A switch as claimed in claim 1, characterized in that said movable contact extends in the direction opposite to the direction of extension of said stationary contact.

12. A switch as claimed in claim 1, characterized in that said arc runner is a planar shape, extends through side of the stationary contact element, and inclined with respect to said stationary contact.

13. A switch as claimed in claim 1, characterized in that said arc runner includes an articulated portion convexed toward the stationary contact element, said arc runner extending into the space above the hollow cut-out portion of said stationary contact through sides of said stationary contact element.

14. A switch as claimed in claim 1, characterized in that comprising a stationary contact carrying at one end thereof a stationary contact element and at the other end thereof a connecting terminal, and a movable contact having a movable contact element disposed in a facing relationship with said stationary contact element and extending in a direction away from said connecting terminal, said stationary contact having formed therein in the vicinity of said the other end of said stationary contact a hollow portion for causing the direction of current relative to said stationary contact to cross the direction of extension of said stationary contact.

15. A switch as claimed in claim 1, characterized in that a channel for communicating the hollow cut-out portion to the exterior of the housing space at the lower portion of the hollow cut-out portion is disposed in a support member for supporting said stationary contact.

16. A switch as claimed in claim 15, characterized in that a generated gas during the extinction of an arc generated between said stationary contact and said movable contact is exhausted to the exterior through said hollow cut-out portion and said channel.

* * * * *